US005140907A

United States Patent [19]

Svatek

[11] Patent Number: 5,140,907

[45] Date of Patent: Aug. 25, 1992

[54] METHOD FOR SURFACE MINING WITH DRAGLINE AND BLAST CASTING

[75] Inventor: Steven M. Svatek, Gillette, Wyo.

[73] Assignee: Atlantic Richfield Company, Los Angeles, Calif.

[21] Appl. No.: 797,604

[22] Filed: Nov. 25, 1991

[51] Int. Cl.[5] ..... F42D 3/00

[52] U.S. Cl. ..... 102/302; 102/312; 102/313; 299/13

[58] Field of Search ..... 102/302, 312, 313; 299/13

[56] References Cited

U.S. PATENT DOCUMENTS

| | | | |
|---|---|---|---|
| 1,872,016 | 8/1932 | Sherwood et al. | 102/302 X |
| 4,135,762 | 1/1979 | Biawcale | 299/13 |
| 4,522,448 | 6/1985 | Nitzberg | 102/312 X |
| 4,545,622 | 10/1985 | Yang | 102/312 X |
| 4,913,233 | 4/1990 | Fitzgibbon, Jr. | 102/313 X |
| 4,966,077 | 10/1990 | Halliday et al. | 102/313 X |

*Primary Examiner*—Peter A. Nelson
*Attorney, Agent, or Firm*—Michael E. Martin

[57] ABSTRACT

Coal and other mineral seams are uncovered to a desired width by blast casting a portion of the overburden above the seam into an adjacent spoil pit, followed by excavation of a keycut between unblasted overburden and a plug portion of the overburden remaining above the seam and adjacent to the spoil pit. The excavated material forms a temporary spoil pile adjacent to the plug portion and covering the blast cast overburden. The plug portion and the temporary spoil pile are reshaped to form a support pad for the excavating apparatus which is moved onto the pad and then excavates the plug portion and reshaped temporary spoil pile to form a spoil pile laterally spaced from the pad so as to uncover the remaining uncovered portions of the seam.

7 Claims, 2 Drawing Sheets

METHOD FOR SURFACE MINING WITH DRAGLINE AND BLAST CASTING

BACKGROUND OF THE INVENTION

1. Field of the Invention

The present invention pertains to a method for removing overburden in a surface mining operation using a dragline type excavator and blast casting of the overburden, both in such a way as to reduce the excavating effort and expose a coal or other mineral seam of substantial width.

2. Background

The efficiency of large scale surface mining methods is important in order to reduce, in many instances, the time required to move overburden material away from the mineral seam sufficiently to permit mining of the mineral material, to save wear and tear on the mining equipment and reduce the overall cost of the mining operation. The volume of material mined and the competitive pricing of many minerals, such as coal, is of such magnitude that savings in excavating time and wear and tear on excavating equipment more than offsets any increased cost due to drilling and blast casting the overburden. One improved method is described and claimed in a patent application entitled: "Earth Excavation Using Blast Casting and Excavating Apparatus", filed of even date herewith in the name of Monica Cummins and assigned to the assignee of the present invention.

SUMMARY OF THE INVENTION

The present invention provides a unique mining method for removing overburden from a coal or other mineral pit, particularly a pit of substantial width.

The present invention also provides a unique method of uncovering a mineral seam by removal of the overburden using a combination of blast casting and a dragline or similar excavating equipment removal methods.

In accordance with one important aspect of the present invention, a unique surface mining method is provided for uncovering a mineral seam of substantial width by blast casting a portion of the overburden from the mineral seam into an adjacent pit which has already been mined, followed by a two-pass overburden removal process using a dragline or similar excavating machine. Prior to the second pass of the dragline, a pad is prepared from a portion of the blast cast material and a portion of the overburden which has been previously mined. In the first dragline pass, a keycut of the overburden is moved into a position to form, at least in part, the pad and in the second pass of the dragline, the lower plug of the blast cast overburden and the previously mined overburden is moved to the final spoil pile to uncover the mineral pit.

In accordance with yet a further aspect of the present invention and improved mining method is provided wherein a dragline support pad is provided for supporting the dragline during the second pass. The support pad is typically provided by bulldozing the blast cast overburden and the dragline rehandle pile. By supporting the dragline on a pad formed by a portion of the blast cast overburden above the mineral pit, but at a lower elevation than the elevation of the overburden before mining, the dragline is not required to mine the plug at the elevation of the overburden prior to blast casting. In this way, dragline operation time is reduced as well as wear and tear on the dragline mechanism.

The above-noted advantages and superior features of the method of the present invention together with other superior aspects thereof will be further appreciated by those skilled in the art of reading the detailed description which follows in conjunction with the drawings.

DESCRIPTION OF A PREFERRED EMBODIMENT

Figure 1:
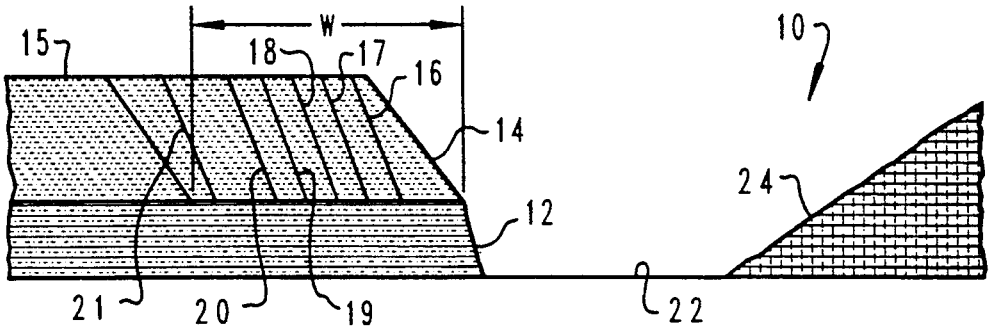
FIGS. 1–6 represent schematic diagrams showing the steps in the method of the present invention.

In the description which follows like elements are marked with the same reference numerals throughout the specification and drawing. The drawing figures are not necessarily to scale and the method is depicted in somewhat schematic form in the interest of clarity and conciseness. The drawing figures show a cross section of a mineral seam, such as a coal seam, uncovered in open pit mining. The "length" of the seam and the pit run normal to the plane of the paper on which the drawing figures are depicted. In other words, the excavating machine to be described progressively moves in a direction normal to the plane of the paper as it progressively transfers material to the lateral positions depicted in the drawings.

Referring to FIG. 1, there is illustrated a cross-sectional view in somewhat schematic form of an open pit coal mine, generally designated by the numeral 10. The mine 10 is being operated to remove material from a coal seam 12 having a vertical thickness relative to overburden, as indicated. A layer of overburden earth material 14 is disposed over the coal seam 12 to an elevation delimited by surface 15 and has been prepared for blast casting by drilling a preselected pattern of blast holes designated by the numerals 16, 17, 18, 19, 20, and 21. The mine 10 includes a pit portion 22 between the coal seam 12 and a spoil pile 24, which pit portion has been formed by previous mining to remove coal therefrom. The mine 10 is being mined to at least remove overburden by a dragline type excavating apparatus, not shown in FIG. 1. The width of the coal seam to be uncovered of overburden material in accordance with the present invention is significant and is on the order of 200 ft. to 250 ft. This width is indicated generally by the dimension "w" in FIGS. 1 and 6. The length of the seam 12 to be uncovered or the so-called "cut" to be taken may be limited only by the geology of the seam or the property boundary of the mine.

Figure 2:
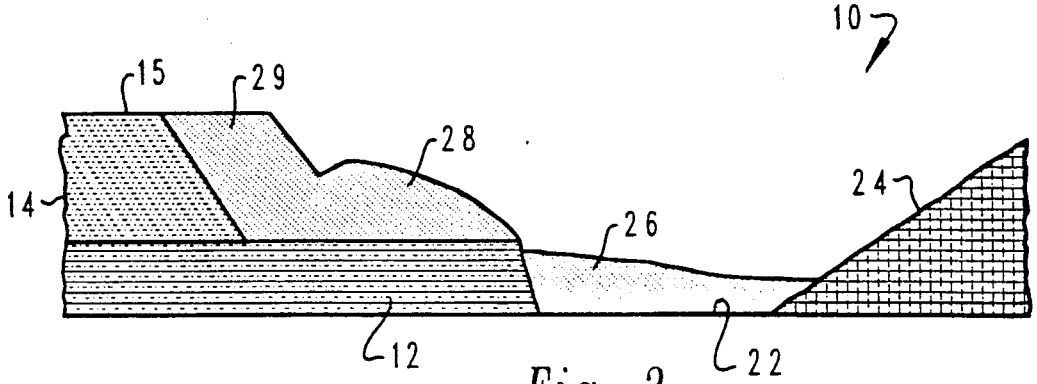

Referring to FIG. 2, there is illustrated the condition of the overburden material which has been blast cast upon loading the blast holes 16, 17, 18, 19, 20 and 21 with suitable explosives and detonating those explosives to fragment and loosen the overburden and cast at least a portion 26 of the overburden into the pit portion 22. The remaining uncast portions 28, 29 of the overburden have nevertheless been fragmented and loosened sufficiently to be excavated by conventional excavating apparatus such as the aforementioned dragline. Thanks to the pattern of the blast holes, at least the portion 29 of the overburden 14 remains uncast and will be removed to form a so-called keycut, by a dragline as will be described further herein.

Blast casting techniques, in general, are known in the art of surface mining, are believed to be within the purview of one skilled in the art and therefore not requiring further discussion herein. Blast casting is discussed in *Coal Mining*, Mar., 1987, pp. 38-40; July, 1987, pp. 30-32; Aug. 1987, pp. 32-34; Sep. 1987, pp. 36-38; and in Coal, June, 1988, pp. 48-50; Nov. 1988, pp. 82-84 and June, 1989, pp. 41-44.

Figure 3:
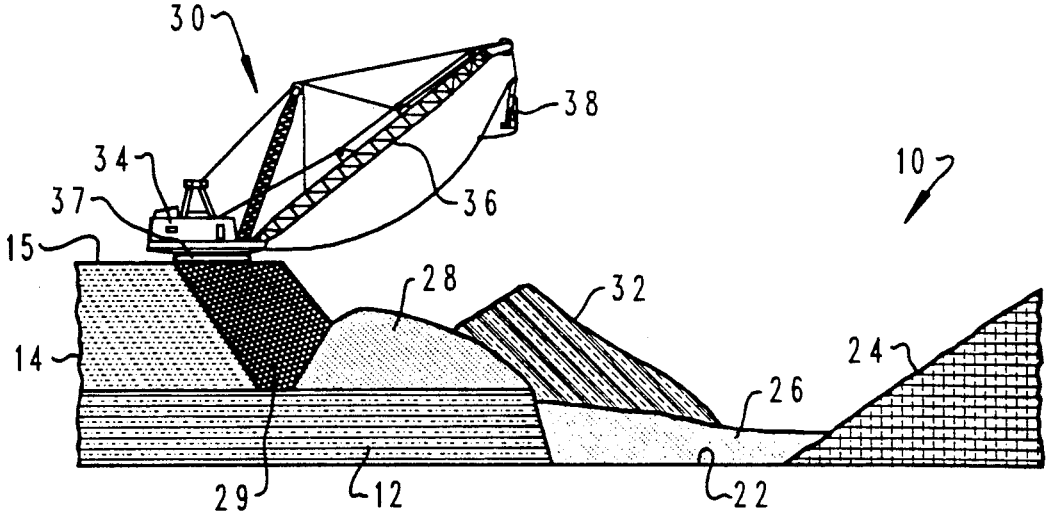
Figure 4:
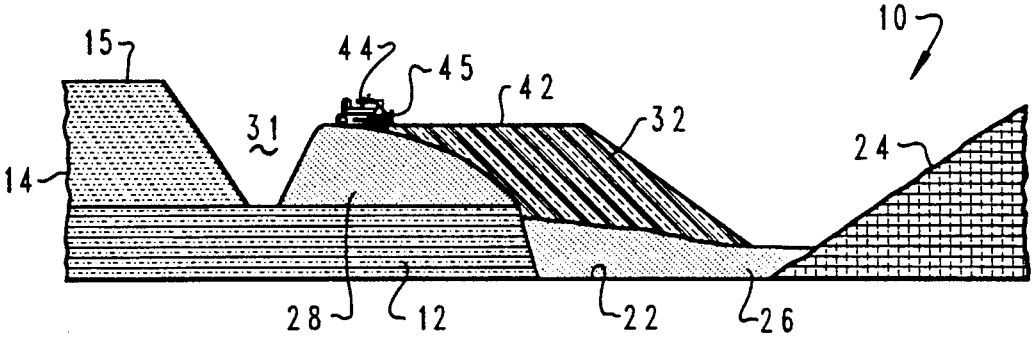
Figure 5:
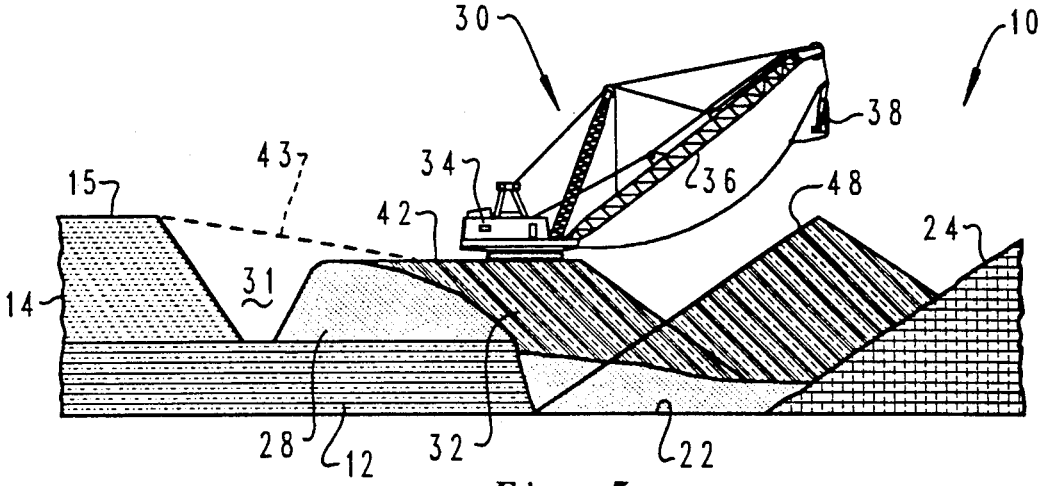

Referring now to FIG. 3, there is illustrated the condition wherein an excavating apparatus 30 comprising a conventional dragline is disposed supported on the keycut overburden portion 29 and will be operated to excavate material to form a keycut space, defined by numeral 31 in FIGS. 4 and 5. In FIG. 3 the dragline 30 has begun excavating the overburden 29 to form at least a temporary spoil pile or rehandle 32. The excavating apparatus 30 includes a house 34 supporting a main boom 36 and a conventional dragline type excavating bucket 38 which is suitably suspended in a conventional manner by hoist and draglines controlled from the machinery of the house 34. The house 34 is suitably mounted on a crawler or walking type undercarriage 37, or the like, for swinging movement so that the keycut overburden 29 can be excavated to form the somewhat wedge or V-shaped keycut space 31, see FIG. 4 also.

Once the excavating apparatus 30 has traversed the length of the portion of the seam 12 to be uncovered and has removed overburden material to form the keycut space 31, the temporary spoil pile 32 and the blasted overburden portion or plug 28 is leveled to form a substantially horizontal pad surface 42. Conventional earth moving or grading equipment such as a tractor or bulldozer 44, including a scraper blade 45, may be used to form the pad support surface 42, as indicated. One major advantage of blast casting the overburden from above the seam 12 to the condition illustrated in FIG. 2 is that, when the excavating apparatus 30 is brought on to the overburden 29 to begin forming the keycut space 31, the lower elevation of the overburden plug portion 28 does not require as great a lifting effort on the dragline bucket 38 in order to form the spoil pile 32 by excavation of the overburden material 29. Advantages are realized in time saving in excavating the keycut space 31 and in wear and tear on the excavating apparatus 30.

Figure 6:
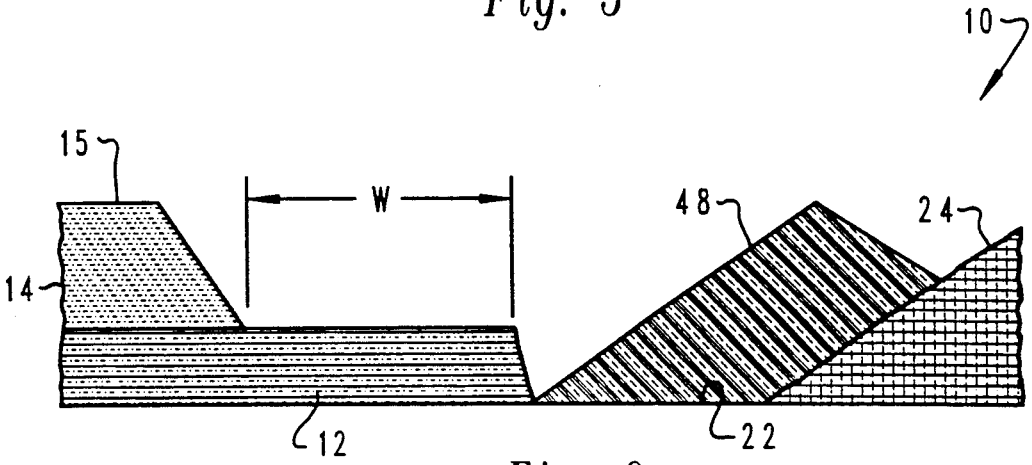

When the excavating apparatus 30 has traversed the length of the portion of seam 12 to be uncovered while forming the keycut space 31 and the pad surface 42 has been formed by the earth moving apparatus 44, the excavating apparatus is then moved onto the pad surface at one end of the seam by way of a suitable earthen ramp 43, as illustrated in FIG. 5, and commences to excavate the remaining overburden, including the ramp, above the prescribed width of the coal seam 12. In excavating the so-called plug portion 28 of the blast cast overburden material, and the reshaped spoil pile or rehandle 32, which together with the overburden 28 forms the pad 42, the excavating apparatus 30 forms a spoil pile 48, as illustrated in FIG. 5, until the apparatus has traversed the length of the seam 12 and all of the overburden material is removed from the seam at least to the width w. The apparatus 30 is then traversed back to the surface 15 by way of another suitable earthen ramp, not shown. The final exposure of the seam 12 is indicated in FIG. 6 where all of the material from the rehandle 32 and the plug portion 28 has been excavated and moved to form the spoil pile 48.

Again, by blast casting a portion of the overburden to a lower elevation than that of the surface 15, and forming the pad surface 42 at substantially such lower elevation, the excavation of the plug portion 28 and rehandle 32 to uncover the coal seam 12 to its width w is carried out with savings in excavation work done by the apparatus 30. Moreover, the coal seam 12 is uncovered to its width w in only two passes of the excavating apparatus 30 along the length of the seam, one pass being to form the keycut space 31 and the other pass to excavate the plug portion 28 and rehandle 32, forming the pad 42, to uncover the seam.

Although a preferred embodiment of the present invention has been described in detail herein, those skilled in the art will recognize that various substitutions and modifications may be made to the method described without departing from the scope and spirit of the appended claims.

What is claimed is:

1. A method for removing overburden from a mineral seam in the earth comprising the steps of:

determining a portion of said seam width to be uncovered;

placing explosive charges in a portion of overburden above said portion of said seam and blast casting overburden above said portion of said seam to a place adjacent to said portion of said seam while leaving a plug portion of overburden resting on said portion of said seam at an elevation generally lower than the height of unblasted overburden;

providing an excavating apparatus;

excavating overburden from above said portion of said seam between said plug portion and said unblasted overburden to form a temporary spoil pile adjacent to said plug portion; and excavating said plug portion and said temporary spoil pile to uncover said seam.

2. The method set forth in claim 1 including the step of:

moving overburden material on at least one of said plug portion and said temporary spoil pile to form a pad for supporting said excavating apparatus.

3. The method set forth in claim 2 wherein:

overburden material is moved to form a generally horizontal pad surface having an elevation lower than the height of said unblasted overburden.

4. The method set forth in claim 2 wherein:

said overburden material is moved to form said pad surface by tractor means having a scraper blade or the like for moving said overburden material to form said pad surface.

5. The method set forth in claim 1 including the step of:

providing said excavating apparatus means comprising a dragline.

6. A method for removing overburden from a mineral seam in the earth comprising the steps of:

determining a portion of said seam width to be uncovered;

placing explosive charges in a portion of overburden above said portion of said seam and blast casting overburden above said portion of said seam to a place adjacent to said portion of said seam while leaving a plug portion of overburden resting on said portion of said seam at an elevation lower than the height of unblasted overburden;

providing an excavating apparatus;

excavating overburden from above said portion of said seam between said plug portion and said unblasted overburden to form a temporary spoil pile adjacent to said plug portion;

moving overburden material on at least one of said plug portion and said temporary spoil pile to form a pad surface having an elevation lower than said unblasted overburden for supporting said excavating apparatus;

moving said excavating apparatus onto said surface; and excavating said plug portion and said temporary spoil pile to uncover said seam.

7. A method for removing overburden from a mineral seam in the earth comprising the steps of:

determining a portion of said seam width to be uncovered;

placing explosive charges in a portion of overburden above said portion of said seam and blast casting overburden above said portion of said seam to a place adjacent to said portion of said seam while leaving a plug portion of overburden resting on said portion of said seam at an elevation lower than the height of unblasted overburden;

providing a dragline excavating apparatus;

excavating overburden from above said portion of said seam between said plug portion and said unblasted overburden to form a temporary spoil pile adjacent to said plug portion;

moving overburden material on said plug portion of said temporary spoil pile to form a pad having an elevation lower than said unblasted overburden for supporting said excavating apparatus;

moving said excavating apparatus onto said pad; and excavating said plug portion and said temporary spoil pile to uncover said seam.

* * * * *